United States Patent [19]

Tacchella

[11] 4,348,838

[45] Sep. 14, 1982

[54] BROACH SHARPENING MACHINE

[75] Inventor: Elio Tacchella, Acqui Terme, Italy

[73] Assignee: Tacchella Macchine S.p.A., Alessandria, Italy

[21] Appl. No.: 206,398

[22] Filed: Nov. 13, 1980

[51] Int. Cl.[3] ..... B24B 19/00

[52] U.S. Cl. ..... 51/34 C; 51/35; 51/92 R; 51/165 R; 76/37; 409/195

[58] Field of Search ..... 51/34 R, 34 C–34 G, 51/35, 36, 55, 56, 92 R, 92 BS, 92 HR, 92 ND, 165, 165.75, 165.76, 165.77, 287, 288; 76/32, 37, 48, 49; 409/193

[56] References Cited

U.S. PATENT DOCUMENTS

| | | | |
|---|---|---|---|
| 1,777,135 | 9/1930 | Bailey | 51/34 C |
| 2,349,324 | 5/1944 | Wiedmann | 51/34 G |
| 2,807,914 | 10/1957 | Pascal et al. | 51/55 X |
| 3,481,224 | 12/1969 | Aijala | 51/35 X |

FOREIGN PATENT DOCUMENTS

| | | | |
|---|---|---|---|
| 1627273 | 8/1970 | Fed. Rep. of Germany | 76/37 |
| 2646209 | 1/1978 | Fed. Rep. of Germany | 51/288 |

*Primary Examiner*—Stephen G. Kunin
*Assistant Examiner*—Robert P. Olszewski
*Attorney, Agent, or Firm*—Gifford, Van Ophem, Sheridan & Sprinkle

[57] ABSTRACT

Broach sharpening machine in which a slide mobile in a direction transverse to the longitudinal axis of a broach to be sharpened supports a sharpening slide provided with a grinding wheel head, and a feeler unit arranged to determine the position of each broach tooth relative to the grinding wheel and comprising an articulated parallelogram in which a drag link is provided with a coupling element arranged to cooperate with the broach teeth, and is connected by two resilient cranks to a frame so that it rotates with this latter about a horizontal axis perpendicular to the broach axis; the feeler unit comprising a sensor for detecting the movements of the frame about its axis of rotation and the axial movements of said drag link, and a resilient element arranged to rotate said parallelogram so as to move said coupling element towards the broach.

8 Claims, 6 Drawing Figures

BROACH SHARPENING MACHINE

BACKGROUND OF THE INVENTION

This invention relates to a broach sharpening machine.

Broaches are tools which are normally of considerable length and comprise a plurality of teeth which when brought into contact in succession with a surface to be machined, give it a required finish and shape by each removing a determined chip thickness which normally varies from one tooth to another and depends on the increase in height of each tooth relative to the preceding tooth. In addition, the fact that the chip thickness removed varies from tooth to tooth means that normally the distribution pitch of the teeth also varies along the broach. Finally, the tooth profile can vary along the broach according to the surface shape to be obtained.

In this respect, it should be noted that broaches are extremely specialised tools, the use of which is justified only for mass production, and provided the broaches can be sharpened a certain number of times.

In general, a broach is sharpened, or rather the cutting edges of its teeth are reconditioned, by sharpening machines of the grinding wheel type, in which a grinding wheel head is moved manually in such a manner as to sharpen the broach teeth one after another. For this purpose, the operator has to identify the position of the cutting edge of each tooth visually, then remove the same chip thickness from each tooth while controlling the grinding wheel such that its outer periphery does not touch the base of the cavity between each pair of adjacent teeth.

Normally, the visual identification of the cutting edge of the teeth with respect to the grinding wheel leads to errors which automatically result in variations in the geometrical form of the broach.

SUMMARY OF THE INVENTION

The object of the present invention is to provide a broach sharpening machine in which the position of the tooth cutting edges is identified rapidly and extremely accurately, independently of the complexity of the shape of the broach to be sharpened.

Said object is attained according to the present invention by a broach sharpening machine, of the type comprising a first sharpening slide arranged to impart, to a grinding wheel supported by it, a movement having a constant stroke away from and towards said broach in a direction transverse to the longitudinal axis of the broach, a second and a third slide mobile along two axes which form a contained angle, the axis of movement of said second slide being parallel to said longitudinal axis, and a feeler unit arranged to determine the position of said grinding wheel relative to each tooth of said broach in succession, characterised in that said third slide supports both said feeler unit and said first slide, and that said feeler unit comprises an articulated parallelogram constituted by a frame rotatable relative to said third slide about an axis perpendicular to the broach axis and to the axis of movement of said second slide, a drag link, and two resilient cranks which connect said drag link and said frame together; the feeler unit also comprising first means for detecting the movements of said frame about its axis of rotation, and second means for detecting the axial movement of said drag link, this latter comprising coupling means arranged to engage with the teeth of said broach positively and in succession, resilient means being connected to said frame in order to move said coupling means towards said broach teeth.

BRIEF DESCRIPTION OF THE DRAWINGS

Further characteristics and advantages of the present invention will be apparent from the description given hereinafter with reference to the accompanying drawings, which show one non-limiting embodiment thereof, and in which.

DETAILED DESCRIPTION OF THE INVENTION

Figure 1:
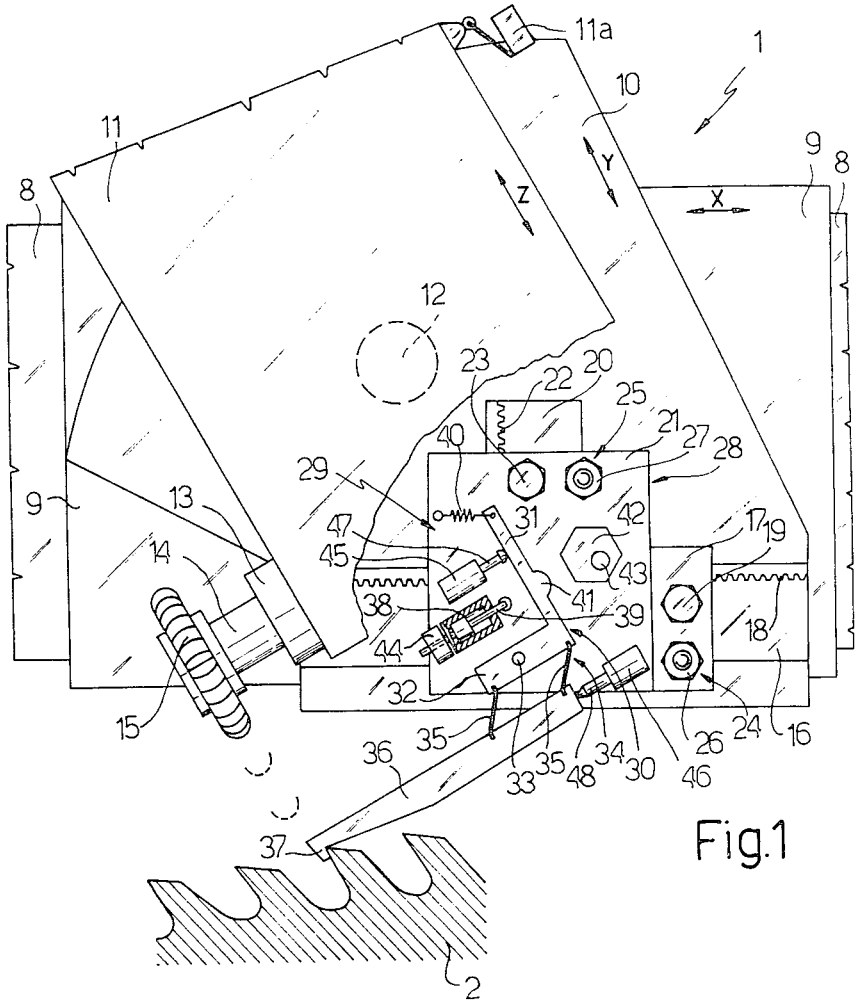
FIG. 1 is a diagrammatic side elevation of a detail of a broach sharpening machine constructed according to the present invention.
Figure 2:
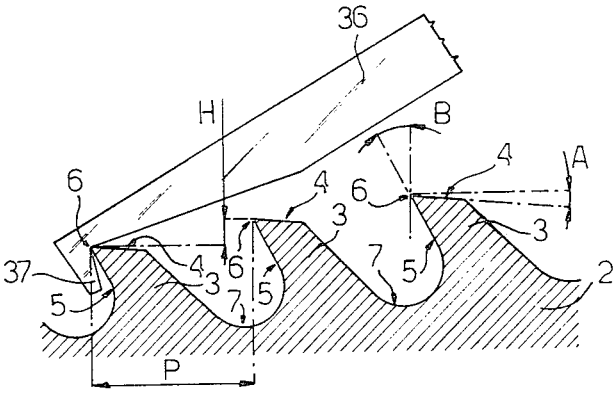
FIG. 2 is a detail of FIG. 1 to an enlarged scale.

FIG. 1 shows part of a broach sharpening machine indicated overall by 1 and comprising a fixed bed (not shown) on which a broach 2 to be sharpened is axially locked in position. The broach, as shown in particular in FIG. 2, comprises a plurality of teeth 3, which are distributed along the broach 2 at a pitch P which is normally variable according to a determined law, and comprise an outer surface or back 4 forming a top rake angle A with the horizontal axis of the broach 2, a front surface 5 defining a cutting edge 6 with the surface 4 and forming a front rake angle B with the perpendicular to the axis of the broach 2, a curved connection surface 7 between adjacent teeth, and an increment H between adjacent teeth which is normally vertical along the broach 2.

In the example shown in the figures, the broach 2 is a round broach, which is fixed on said bed (not shown) of the machine 1 by means of centres (not shown). However, the machine 1 can also be adapted to receive flat broaches mounted directly on said bed.

Said bed supports an upper fixed slide guide 8 for a first slide 9 which is arranged to move along the guide 8 under the action of drive means, not shown, in a direction X parallel to the axis of the broach 2.

A second and a third slide indicated respectively by 10 and 11 are mounted on the slide 9 in such a manner as to be able to slide under the thrust of respective drive means, not shown. The slide 10 is mounted on the slide 9 such that it slides relative to this latter in a direction Y substantially perpendicular to the direction of movement of the slide 9, while the slide 11 is a sharpening slide and is mounted on guides (not shown) connected to the slide 9 in an angularly adjustable manner by means of a pin 12, and lockable relative to the slide 9 in such a manner as to enable the slide 11 to move in a direction Z which forms a determined adjustable angle with the perpendicular to the axis of the broach 2. The slide 11 can be moved by drive means, not shown, in such a manner that it carries out a fixed outward and return stroke in the direction Z between a first position controlled by a limit switch 11*a* carried by the slide 10, and a second determined position closer to the broach 2.

A grinding wheel head 13 is mounted on the slide 11, and from which there transversely projects a spindle 14 onto the end of which is keyed a grinding wheel 15.

On that end of the slide 10 facing the broach 2 to be sharpened, there is disposed a guide 16 extending parallel to the direction X and supporting a slide 17 mobile in one direction or the other along the guide 16 under the thrust of a pinion (not shown) which engages with a rack 18 carried by the guide 16, and is keyed onto a shaft (not shown) which is mounted rotatably through the slide 17 and is provided with a hexagonal operating head 19.

A second guide 20 is connected rigidly to the slide 17 perpendicular to the guide 16, and supports a plate 21 which is mobile along the guide 20 under the thrust of a pinion (not shown) which engages with a rack 22 carried by the guide 20, and is keyed onto a shaft (not shown) mounted rotatably through the plate 21 and provided with a hexagonal operating head 23. The slide 17 and plate 21 can be locked along the relative guides 16 and 20 by respective locking devices 24 and 25 operated by respective hexagonal nuts 26 and 27.

The guides 16 and 20, the slide 17, the plate 20, the said two pinion-rack couplings and the locking devices 24 and 25 constitute together an adjustment device, indicated overall by 28, by means of which the position of a feeler unit, indicated overall by 29 and arranged to determine the exact position of a tooth 3 to be sharpened, can be adjusted relative to the slide 10.

The feeler unit 29 comprises a rocker lever 30 consisting of a first arm 31 extending substantially in the direction Y, and a second arm 32 perpendicular to the arm 31 and rigid with that end of this latter which faces the broach 2. The rocker lever 30 is mounted rotatably on a pin 33 rigid with the plate 21, and is perpendicular to this latter and to the broach 2, and rotatably engages in a through bore provided in the centre of the arm 32.

The arm 32 is in the form of a bar of parallelepiped section, and constitutes the frame of a resilient articulated parallelogram 34, of which the cranks are constituted by two resilient strips 35 extending towards the broach 2 from a lateral surface of the arm 32, and of which the drag link is constituted by a terminal portion of a feeler rod 36 extending parallel to the arm 32 towards the grinding wheel 15, and comprising a tooth or pawl 37 at that end distant from the end connected to the strips 35 and extending towards the broach 2.

The feeler unit 29 also comprises a linear actuator 38, which in this case is a pneumatic actuator, supported by the plate 21 and comprising an exit rod 39 mobile between a retracted limiting position in which a roller rotatably mounted on the free end of the rod 39 is separated from the arm 31 of the rocker lever 30, and an extracted position in which said roller cooperates with a lateral surface of the arm 31 which faces the grinding wheel 15, and by overcoming the return force of a spring 40 stretched between the free end of the arm 31 and the plate 21 keeps a protuberance 41 on the arm 31 in contact with one of the lateral faces of a hexagonal stop cam 42 rotatably mounted on the plate 21 by means of an eccentric pin 43.

The stoppage of the rod 39 in said two positions is sensed by a sensor 44 mounted on one end of the linear actuator 38.

Finally, the feeler unit 29 comprises two linear differential electronic transducers 45 and 46, of which the first is disposed on the plate 21 in a position to the side of the actuator 38 and comprises a mobile rod 47, the end of which is arranged to come into contact with the lateral surface of the arm 31 facing the grinding wheel 15, and of which the second is disposed on the plate 21 on the same side as the cam 42 relative to the arm 31, and comprises a mobile rod 48, the free end of which is arranged to come into contact with that end of the feeler rod 36 distant from the end which carries the pawl 37.

When in operation, the sharpening of the broach 2 fixed axially to the bed (not shown) of the machine 1 is preceded by a setting-up stage which is of absolute importance for the correct execution of the subsequent sharpening cycles.

Figure 6:
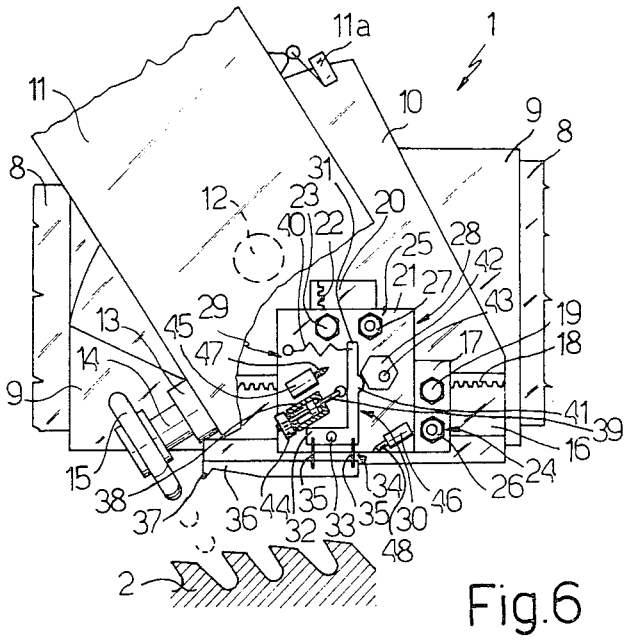

The setting-up of the machine 1 is carried out on the first tooth of the broach 2 starting from the position shown in FIG. 6, and after deactivating all the automatic control devices which may be present in the machine 1.

Normally, the first operation carried out by the operator who sets up the machine is to position the slide 11 about the pin 12 in such a manner that the direction Z of movement of the slide 11 is perfectly parallel to the front surfaces 5 of the teeth 3 to be sharpened. The operator then operates the slide 11 by moving it towards the broach 2 until it reaches its limiting position, and then operates the slide 10 so as to move the slide 11, locked in said limiting position, until the periphery of the grinding wheel 15 is in proximity to, but not in contact with, the curved surface 7 located upstream of the first tooth 3 to be sharpened.

When the slide 10 has been locked in the aforesaid position, the operator moves the slide 11 backwards until it operates the microswitch 11*a*, and operates the actuator 38 so as to move the rod 39 into its retracted limiting position. In this manner, the operator releases the rocker lever 30, which rotates under the thrust of the spring 40 about the pin 33 until it reaches a position similar to that shown in FIG. 4. In this position, the rod 36 is disposed with its lateral surface in contact with the cutting edge 6 of the first tooth 3 of the broach 2, and compresses the rod 48 of the transducer 46, whereas the arm 31 of the rocker lever 30 compresses the rod 47 of the transducer 45.

As is normally the case for all differential linear transducers, the transducers 45 and 46 are arranged to emit an electrical signal which varies linearly with the axial position of their mobile rod between a maximum positive value, corresponding to the position assumed by the mobile rod when unstressed, and, after passing through zero, a negative maximum value which corresponds to an intermediate position of the mobile rod.

Figure 4:
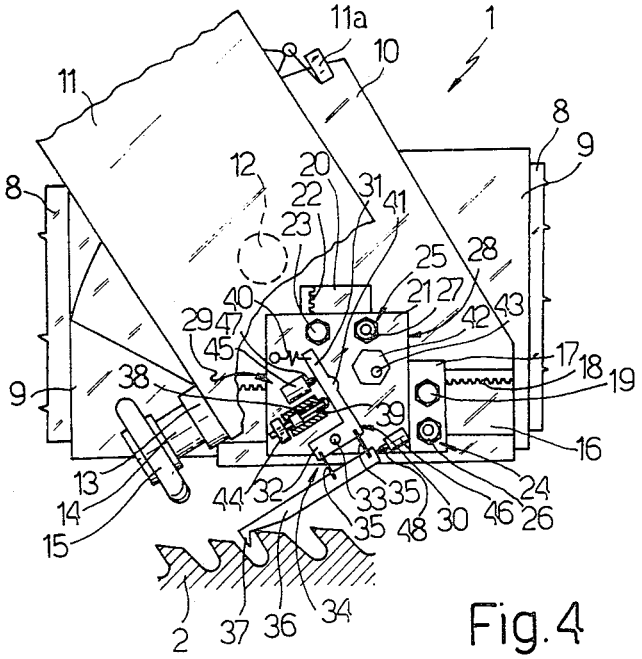
Figure 5:
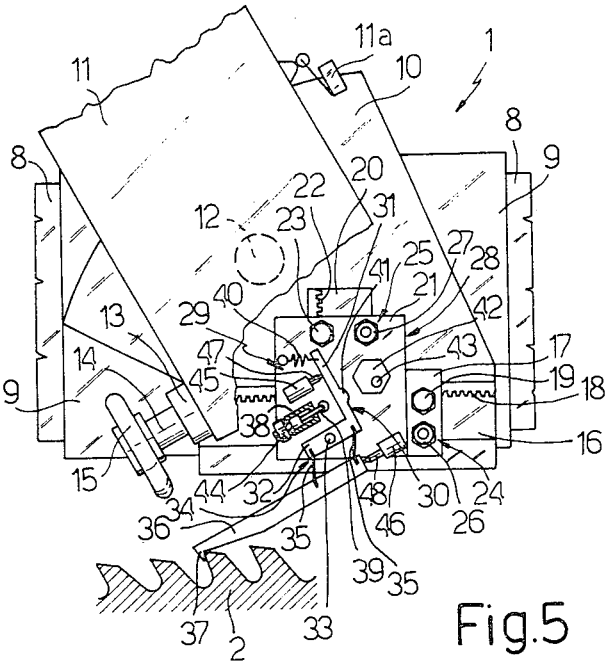

When the rod 36 is in the position shown in FIG. 4 on the first tooth 3 of the broach 2, the signals emitted by the transducers 45 and 46 are in general strongly negative, and are reduced by the operator moving the slide 9 to bring the pawl 37 into engagement with the first tooth 3, then continuing the movement in the direction X until the grinding wheel 15 is aligned with the front surface 5 of the first tooth 3 in a position analogous to that shown in FIGS. 1 and 5.

The engagement between the pawl 37 and tooth 3 leads to the stoppage of the axial movement of the rod 36, so that any further movement of the slide 9 in the direction X results in deflection of the resilient strips 35. Simultaneously with this deflection, there is an axial movement of the rod 36 relative to the transducer 46, the rod 48 of which moves outwards, and a rotation about the pin 33 (in the clockwise direction in the figures) of the rocker lever 30, the arm 31 of which withdraws from the transducer 35, so enabling its rod 47 to move outwards. In other words, the progressive deflection of the strips 35 leads to a progressive reduction, in absolute value, of the output signals of the transducers 45 and 46.

The operator halts the slide 9 when that surface of the grinding wheel 15 facing the spindle 14 is perfectly aligned with the front surface 5 of the first tooth 3 to be sharpened. He then completely zeroes the output signals of the transducers 45 and 46 by means of the adjustment device 28. For this purpose, the operator firstly loosens the nuts 26 and 27, and then turns the heads 19 and 23 to move the slide 17 and plate 21 along the respective guides 16 and 20 until the plate 21 becomes located in a position corresponding to zero output of the transducers 45 and 46. The setting-up stage for the machine 1 terminates by locking the plate 21 in said position by means of the nuts 26 and 27, and by the operator setting a feed value for the slide 9 on a known automatic device (not shown), this value corresponding to the chip thickness, which the grinding wheel 15 is required to remove for each pass.

Summarising the aforesaid, it can be stated that the setting-up of the machine 1 consists of adjusting the feeler unit 29 in such a manner that zero output of the transducers 45 and 46 corresponds to perfect alignment of the surface of the grinding wheel 15 with the front surface of the first tooth 3 to be sharpened.

When setting-up is completed, the operator operates a knob (not shown) disposed on the control panel (not shown) for the machine 1, to start the automatic sharpening cycle, which is described hereinafter starting from the position reached during the setting-up stage on the first tooth 3 to be sharpened, and corresponding to the position shown in FIG. 5.

In the automatic cycle, when the output signal of the transducers 45 and 46 is zero, the actuator 38 operates such that its rod 39 engages with the arm 31 to rotate the rocker lever 30 (in a clockwise direction in FIG. 6) until the protuberance 41 comes into contact with the hexagonal cam 42, against which it stops. This rotation of the rocker lever 30 causes the release of the pawl 37 from the first tooth 3, and the upward rotation of the rod 36 (FIG. 6), which stops in a position in which it is raised to an extent which depends on the angular position of the cam 42. The function of this latter is precisely to allow adjustment of the raised position of the rod 36, the pawl 37 of which must move higher the smaller the diameter of the grinding wheel 15 used.

The stoppage of the rod 39 due to contact between the protuberance 41 and cam 42 is detected by the sensor 44, which activates, in succession, said automatic feed device (not shown) which causes the slide 9 to make a movement equal to a constant pass depth of the grinding wheel 15, and a drive motor (not shown) for the slide 11, which moves towards the broach 2 until the grinding wheel 15 is caused to sharpen the first tooth 3, and then withdraws from the broach 2 and stops following operation of the microswitch 11*a*.

The operation of the microswitch 11*a* causes the actuator 38 to operate, such that its rod 39 is moved into the withdrawn position, so releasing the rocker lever 30 which rotates (in the anticlockwise direction in FIG. 3) under the thrust of the spring 40, until the end of the pawl 37 rests on the back 4 of the first tooth 3 which has been previously sharpened.

The stoppage of the rod 39 in its withdrawn position is detected by the sensor 44, which activates a control device (not shown) for two drive motors (not shown) for the slides 9 and 10.

Figure 3:
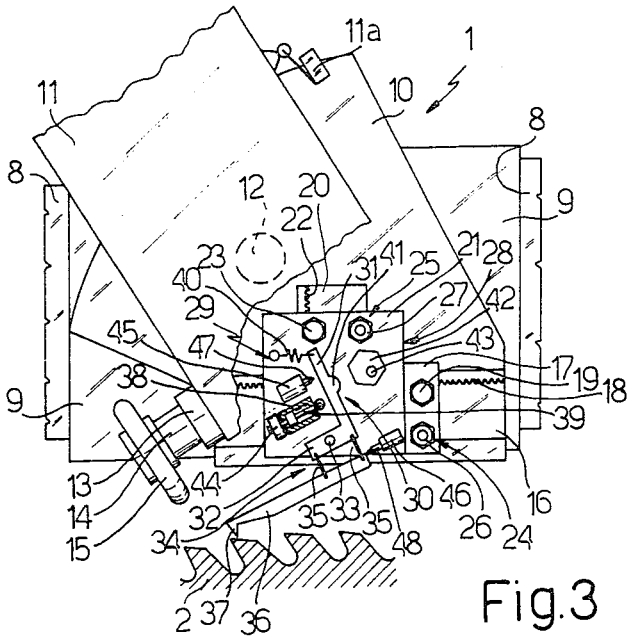
FIGS. 3 to 6 show the detail of FIG. 1 during different stages of operation.

When the rocker lever 30 and rod 36 are in the position shown in FIG. 3, the signals emitted by the transducers 45 and 46 are certainly other than zero, and are fed to said control device (not shown) as error signals, to respectively cause operation of said two drive motors (not shown) for the slides 10 and 9, which move until said signals are zeroed.

With regard to the aforesaid, it should be noted that the value of the signal emitted by the transducer 46 is influenced, except for very small variations, only by the engagement between the pawl 37 and a tooth 3 of the broach 2. Consequently, the slide 9, controlled by the transducer 46, moves (towards the right in FIGS. 3, 4 and 5) with a substantially constant speed, to slow down when the pawl 37 engages with the second tooth 3 of the broach 2, and finally to stop when the output signal of the transducer 46 is zero. In contrast, the value of the signal emitted by the transducer 45 is normally positive when the pawl 37 (FIG. 3) rests on the back 4 of the first tooth 3 of the broach 2, and then suddenly passes to a negative value when the pawl 37 precipitates (FIG. 4) into the space between the first and second tooth. Consequently, the slide 10, controlled by the transducer 45, moves firstly such as to withdraw from the broach 2, and then reverses its movement so as to approach the broach 2, until it stops (FIG. 5) when the output signal of the transducer 45 is zero.

When the slides 9 and 10 reach the new zero position, the position assumed by the grinding wheel 15 relative to the cutting edge 6 of the second tooth 3 is exactly identical to that assumed by the grinding wheel 15 relative to the cutting edge 6 of the first tooth 3 in the preceding zero position reached during the setting-up stage. In other words, the feeler unit 29 has controlled the movement of the slides 9 and 10 in such a manner that the final movement made by the slide 9 is exactly equal to the pitch P between the first tooth 3 and the second, and the final movement of the slide 10 corresponds to a withdrawal of the grinding wheel 15 from the axis of the broach 2 which is exactly equal to the increment H between the first tooth 3 and the second.

As stated heretofore, when the zero position is reached, this automatically causes the rod 39 to operate, and its stoppage in the extracted position (FIG. 6) causes the sensor 44 to automatically cause the slide 9 to advance through a distance equal to the constant pass depth, and to subsequently cause the slide 11 to operate.

At this point, the stages heretofore described are repeated, and the sharpening cycles automatically follow each other until all the teeth 3 of the broach 2 have been sharpened.

Although in the embodiment heretofore described by way of non-limiting example, the broach 2 is fixed and the grinding wheel 15 is made to move along the X axis, it is obviously possible to construct a sharpening machine in which the broach 2 itself moves along the X axis.

Furthermore, although the machine 1 described by way of non-limiting example is a sharpening machine of completely automatic cycle, it is clear that the feeler unit 29 can advantageously be mounted on semi-automatic or manual sharpening machines, i.e. on machines in which at least part of the movements along the X, Y and Z axes are not controlled automatically by the tracer unit 29.

With regard to the aforegoing, it should be noted that the working capacity of the described machine 1 does not depend so much on the fact that once a position has been reached corresponding to zero output of the transducers 45 and 46, the machine 1 is capable of automatically effecting the sharpening cycle, nor on the fact that the zero output position of the transducers 45 and 46 is sought automatically, but rather on the fact that the feeler unit 29 enables a simple, rapid and extremely precise determination to be made of the position in which the grinding wheel head 13 has to be disposed for the grinding wheel 15 to be perfectly aligned with the front surface 5 of the tooth 3 to be sharpened. In other words, by using the feeler unit 29, it is possible to sharpen all the teeth of a broach 2 with extreme accuracy and in the same manner, and the broach, even after numerous sharpening cycles, will preserve its geometrical characteristics substantially intact.

Finally, it should be noted that if all the operations described with reference to FIGS. 3 and 6 are carried out but excluding the operation of the slide 11, this being excluded by a simple operation carried out on the control panel (not shown) of the machine 1, and if the output of the feeler unit 29 is connected to any visual display device of known commercial type, it is possible to operate the machine 1 as a test bench able to check the geometrical characteristics of any broach mounted on the machine bed 1.

Numerous modifications can be made to the described machine 1 within the principle of the invention, without leaving the scope of the inventive idea.

What I claim is:

1. A broach sharpening machine, of the type comprising a first sharpening slide arranged to impart, to a grinding wheel supported by it, a movement having a constant stroke away from and towards said broach in a direction transverse to the longitudinal axis of the broach, a second and a third slide mobile along two axes which form a contained angle, the axis of movement of said second slide being parallel to said longitudinal axis, and a feeler unit arranged to determine the position of said grinding wheel relative to each tooth of said broach in succession, characterised in that said third slide supports both said feeler unit and said first slide, and that said feeler unit comprises an articulated parallelogram constituted by a frame rotatable relative to said third slide about an axis perpendicular to the broach axis and to the axis of movement of said second slide, a drag link, and two resilient cranks which connect said drag link and said frame together; the feeler unit also comprising first means for detecting the movements of said frame about its axis of rotation, and second means for detecting the axial movement of said drag link, this latter comprising coupling means arranged to engage with the teeth of said broach positively and in succession, resilient means being connected to said frame in order to move said coupling means towards said broach teeth.

2. A machine as claimed in claim 1, characterised in that said second slide is mobile relative to said broach, and supports said third slide.

3. A machine as claimed in claim 1, characterised in that said feeler unit is supported by said third slide by way of means for adjusting the position of said feeler unit relative to said third slide.

4. A machine as claimed in claim 3, characterised in that said adjustment means comprise a first guide rigid with said third slide and parallel to said longitudinal axis, a fourth slide mounted slidable along said first guide, a second guide carried by said fourth slide and extending perpendicular to said first guide, and a fifth slide mounted slidable along said second guide; drive means being provided for moving said fourth slide and said fifth slide along their respective guides, and locking means being provided for locking said fourth slide and said fifth slide on their respective guides.

5. A machine as claimed in claim 1, characterised in that each of said resilient cranks is constituted by a resilient strip.

6. A machine as claimed in claim 1, characterised in that said feeler unit comprises thrust means arranged to cooperate with said frame in such a manner as to rotate it about the relative axis of rotation against the action of said resilient means, stop means being provided in order to halt said frame.

7. A machine as claimed in claim 6, characterised in that said stop means comprise a cam of polygonal outer profile, rotatable about an eccentric axis.

8. A machine as claimed in claim 1, characterised in that said first and second detection means are constituted by respective linear differential transducers, of which the output signals control the movements of said third slide and said second slide respectively.

* * * * *

UNITED STATES PATENT AND TRADEMARK OFFICE

CERTIFICATE OF CORRECTION

PATENT NO. : 4,348,838

DATED : September 14, 1982

INVENTOR(S) : Elio Tacchella

It is certified that error appears in the above—identified patent and that said Letters Patent is hereby corrected as shown below:

Column 1, line 21, delete "specialised" and insert --specialized--.

Column 2, line 18, after "THE" insert --PREFERRED EMBODIMENT OF THE PRESENT--.

Column 2, line 37, delete "centres" and insert --centers--.

Column 2, line 64, delete "transversely".

Column 3, line 27, delete "rigid with that" and insert --affixed to the--.

Column 3, line 27, delete "this latter" and insert --arm 31--.

Column 3, line 29, delete "rigid with" and insert --affixed to--.

Column 3, line 31, delete "centre" and insert --center--.

Column 5, line 18, delete "Summarising" and insert --Summarizing--.

Column 6, line 62, delete "tracer" and insert --feeler--.

Column 7, line 37, delete "characterised" and insert --characterized--.

Column 8, line 8, delete "characterised" and insert --characterized--.

Column 8, line 11, delete "characterised" and insert --characterized--.

Column 8, line 15, delete "characterised" and insert --characterized--.

UNITED STATES PATENT AND TRADEMARK OFFICE

CERTIFICATE OF CORRECTION

PATENT NO. : 4,348,838

DATED : September 14, 1982

INVENTOR(S) : Elio Tacchella

It is certified that error appears in the above—identified patent and that said Letters Patent is hereby corrected as shown below:

Column 8, line 16, delete "rigid" and insert --affixed to--.

Column 8, line 17, delete "with".

Column 8, line 26, delete "characterised" and insert --characterized--.

Column 8, line 29, delete "characterised" and insert --characterized--.

Column 8, line 35, delete "characterised" and insert --characterized--.

Column 8, line 38, delete "characterised" and insert --characterized--.

Signed and Sealed this

Third Day of May 1983

[SEAL]

*Attest:*

GERALD J. MOSSINGHOFF

*Attesting Officer*

*Commissioner of Patents and Trademarks*